US006802393B2

(12) United States Patent
Zheng

(10) Patent No.: US 6,802,393 B2
(45) Date of Patent: Oct. 12, 2004

(54) FOLDABLE LADDER

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 10/178,094

(22) Filed: Jun. 25, 2002

(65) Prior Publication Data

US 2003/0234140 A1 Dec. 25, 2003

(51) Int. Cl.[7] ..... E06B 3/92
(52) U.S. Cl. ..... 182/159; 182/157; 182/178
(58) Field of Search ..... 182/159, 96, 118, 182/156, 157, 152, 160, 178

(56) References Cited

U.S. PATENT DOCUMENTS 4,524,847 A * 6/1985 Mintz ..... 182/23
4,560,030 A * 12/1985 Mucelli ..... 182/118
5,158,151 A * 10/1992 Chang ..... 182/159
5,170,862 A * 12/1992 Chang ..... 182/159
5,685,394 A * 11/1997 Simsom ..... 182/159
6,536,558 B2 * 3/2003 Price ..... 182/162
2004/0026173 A1 * 2/2004 Hillebrecht et al. ..... 182/159

* cited by examiner

*Primary Examiner*—Bruce A. Lev
(74) *Attorney, Agent, or Firm*—Raymond Y. Chan; David and Raymond Patent Group

(57) ABSTRACT

A foldable ladder includes a back supporting frame and a front supporting frame, a plurality of foot supporters provided on the front supporting frame in a pivotally foldable manner, a plurality of coupling arrangements for coupling the foot supporters with the front supporting frame, and a foot supporters folding control mechanism for folding or unfolding all the foot supporters in a simultaneous manner. The foot supporters are adapted of folding between a folded position and an unfolded position, wherein in the folded position the first and the second step member are pivotally and upwardly folded toward the first and the second front side legs respectively, and wherein in the unfolded position, the first and the second step member are pivotally and downwardly unfolded from each other to an extent that the step surface of the first step member is well-aligned with the step surface of the second step member, while the step surfaces are kept horizontal.

9 Claims, 10 Drawing Sheets

FOLDABLE LADDER

BACKGROUND OF THE PRESENT INVENTION

1. Field of Invention

The present invention relates to a ladder, and more particularly to a foldable ladder wherein all its step bars can be folded up laterally to form a compact structure for easy storage and carrying.

2. Description of Related Arts

Ladder has widely been used for several purposes, both domestic and industrial. It facilitates convenient and easy access to overhead working platforms which are frequently required for fixing and installing overhead equipments. A conventional foldable ladder comprises a front supporting frame and a back supporting frame pivotally connected with each other to form an inverted foldable 'V' structure, wherein a plurality of unfoldable foot supporters is provided on the front supporting frame. The front frame and the back frame each comprises a first and a second side leg for supporting the ladder.

Conventionally, a so-called 'foldable' ladder is only foldable in the sense that its front frame can be pivotally folded toward the back frame or vice versa. In other words, it can only be folded in one-dimension. Very often, such one-dimensional folding still results in a bulky ladder which is inconvenient and difficult to store and carry. Due to huge demand of ladder, a more compactly folded ladder has been required and chased by consumers.

By a simple analysis of a conventional ladder, as described above, one may easily discover that if all the foot supporter could be folded to receive into two side legs of the ladder, the size of the ladder would be greatly reduced. But, from engineering's point of view, folding all the foot supporters of the ladder while keeping its stability sound and supporting ability unaffected is somewhat difficult and baffling.

First and foremost, if the foot supporters are foldable, each of them is unavoidably movable. And if all the foot supporters are movable, their strength and stability of load carrying are difficult to ensure. Therefore, some sorts of highly reliable reinforcements have to be equipped to supplement the strength and stability lost and this is not successful for granted. If handled carelessly, the ladder will not be rigid enough and may cause harmful to its users.

Besides, in order that the foot supporters are foldable, each of which should be pivotally connected to the side leg in which it is mounted. Each foot supporter has a step surface formed between two ends thereof, when the ladder is in use, the step surface has to be horizontal so that the users are able to climb up along the ladder through the foot supporters. Typical pivotal joints only allow the foot supporters to pivotally move toward the side legs and no more. When the ladder is in use, the front and the back frame are usually fully unfolded and thus the side legs are inclined at an angle θ with respect to the ground. If the foot supporters are mounted in such a manner that their respective step surfaces are horizontal when the front and the back supporting frames are folded, then, when the ladder is unfolded, the originally horizontal foot supporters will follow the unfolding motion of the side legs and finally, as in the case of the side legs, make an inclination with respect to horizontal.

Furthermore, every time the users fold and unfold the ladder, he, she has to fold or unfold each individual foot supporter. This not only brings huge trouble to the users, but also wastes the users' time a lot.

SUMMARY OF THE PRESENT INVENTION

A main object of the present invention is to provide a foldable ladder wherein when the ladder is fully unfolded, a step surface of each of the foot supporter is kept horizontal.

Another object of the present invention is to provide a foldable ladder which can be folded into a more compact size as compared with conventional foldable ladders for easy and convenient carrying and storage.

Another object of the present invention is to provide a foldable ladder comprising a plurality of foot supporters which can be folded up and received into the side legs of the ladder without sacrificing the supporting strength and stability of the ladder.

Another object of the present invention is to provide a foldable ladder wherein all the foot supporters can be folded up and unfolded simultaneously.

Another object of the present invention is to provide a foldable ladder wherein no expensive or complicated mechanical structure is employed to achieve the abovementioned objects.

Another object of the present invention is to provide a foldable ladder which can be easily operated and that no complicated folding and unfolding procedure is involved.

Accordingly, in order to accomplish the above objects, the present invention provides a foldable ladder which comprises:

a ladder supporting frame, comprising:

a back supporting frame which comprises a first and a second parallel back side legs; and a front supporting frame which comprises a first and a second parallel front side legs each having an inner receiving surface formed thereon, wherein the first and the second front side legs are pivotally connected to the first and the second back side legs respectively so that the ladder supporting frame is capable of selectively folding between an operative mode and a standby mode, wherein in the operative mode, the front supporting frame is pivotally unfolded apart from the back supporting frame so that said front supporting frame is inclinedly supported with respect to horizontal, and wherein in the standby mode, the back and the front supporting frame are pivotally folded to overlap with each other;

means for retaining the ladder supporting frame in the operative mode;

a plurality of foot supporters, each comprising a first and a second step member, wherein each step member has an outer end portion, an inner end portion and a step surface formed therebetween;

a pivot joint pivotally connecting the inner end portions of the first and second step member;

a plurality of coupling arrangements spacedly supported by the first and the second front side legs respectively, wherein the outer end portions of the first and the second step member of each of the foot supporters are pivotally coupled with the coupling arrangements in such a manner that each of the foot supporters is capable of being folded between a folded position and an unfolded position, wherein in the folded position, the first and the second step member are pivotally folded toward each other so as to reduce a distance between the first and the second front side leg, wherein in the unfolded position, the first and the second step member are pivotally unfolded from each other to an extent that the step surfaces of the first step member is well-aligned with the step surface of the second step member; and a foot supporter folding control mechanism, which comprises:

a folding controller pivotally connecting the pivot joints in such a manner that the folding controller is capable of folding the foot supporters simultaneously between the folded position and the unfolded position.

BRIEF DESCRIPTION IF THE DRAWINGS

Figure 4A:
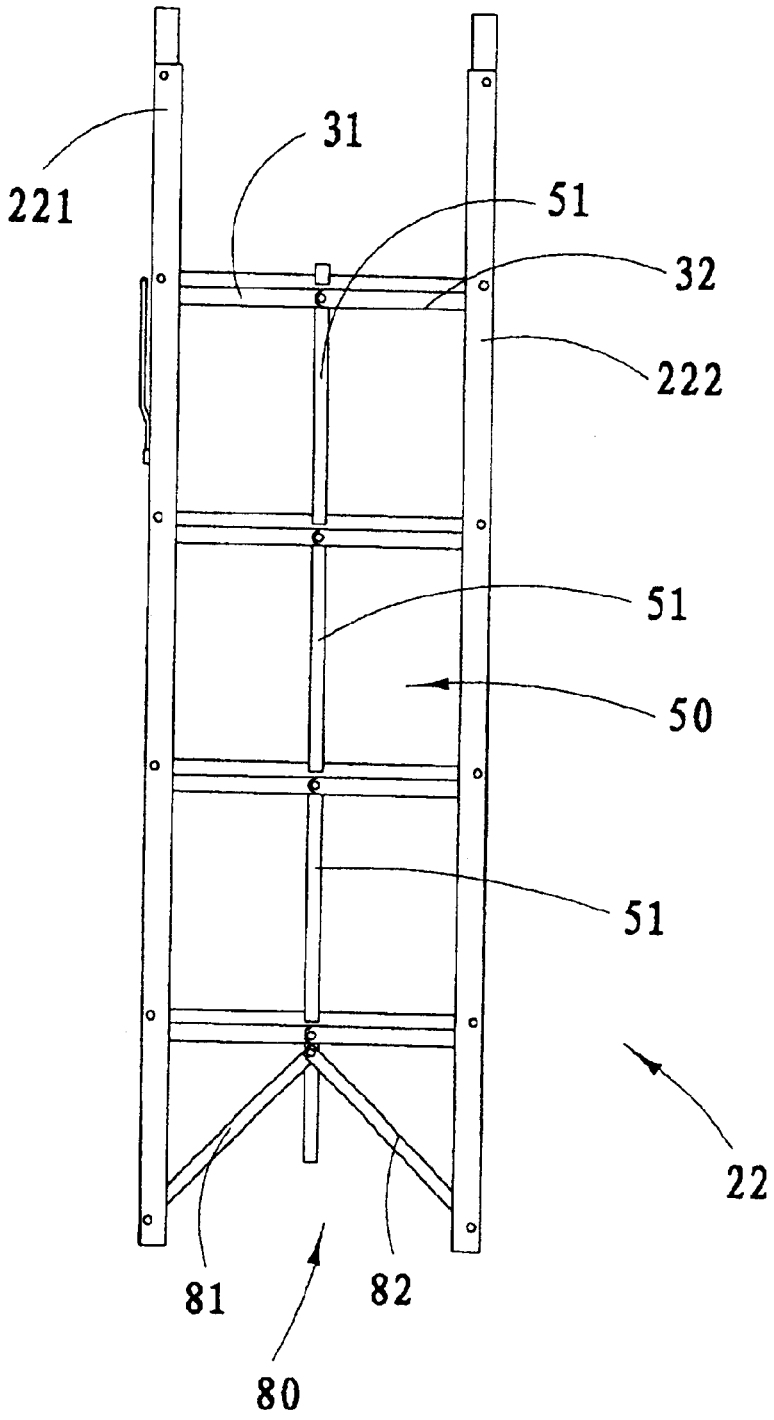

FIG. 4*a* is a side view of the front supporting frame of the foldable ladder according to the above first preferred embodiment of the present invention, illustrating that the foot supporters are in unfolded position.

Figure 4B:
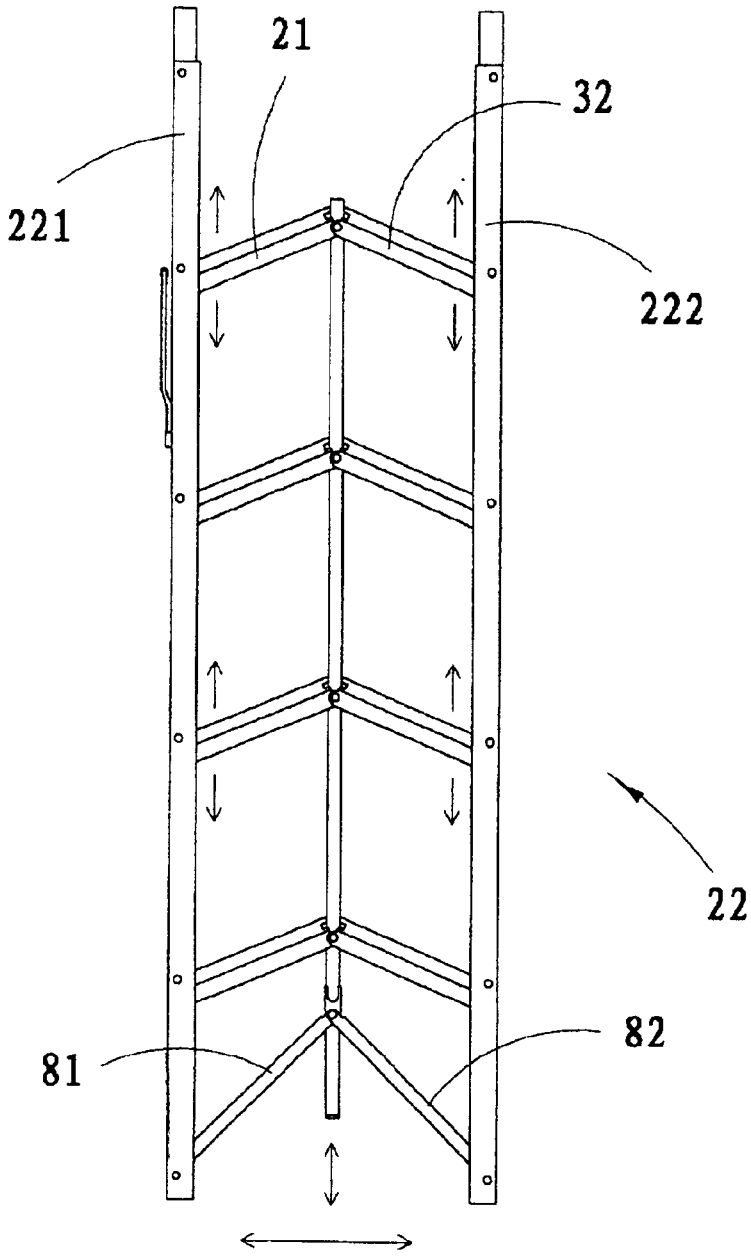

FIG. 4*b* is a side view of the front supporting frame of the foldable ladder according to the above first preferred embodiment of the present invention, illustrating that the foot supporters are being folded.

Figure 5:
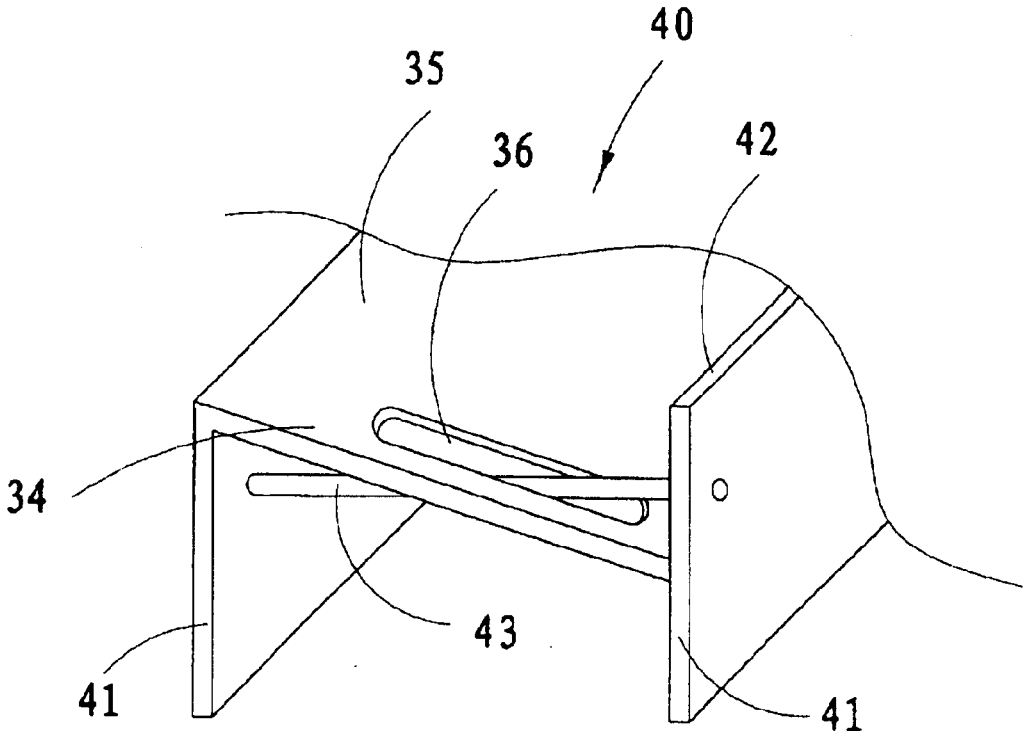

FIG. 5 is a perspective view of the coupling arrangement of the foldable ladder according to the above first preferred embodiment of the present invention.

Figure 6A:
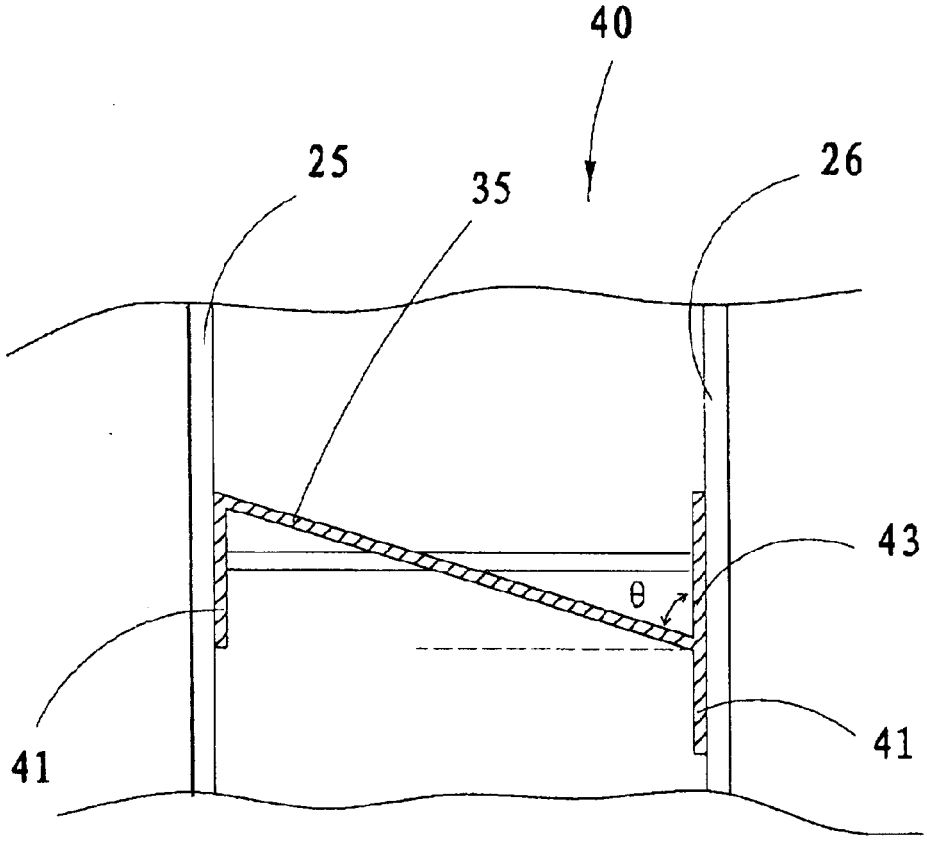

FIG. 6*a* is a sectional side view of the coupling arrangement of the foldable ladder according to the above first preferred embodiment of the present invention, illustrating that the front supporting frame is in standby mode and the step surface is inclined with respect to horizontal.

Figure 6B:
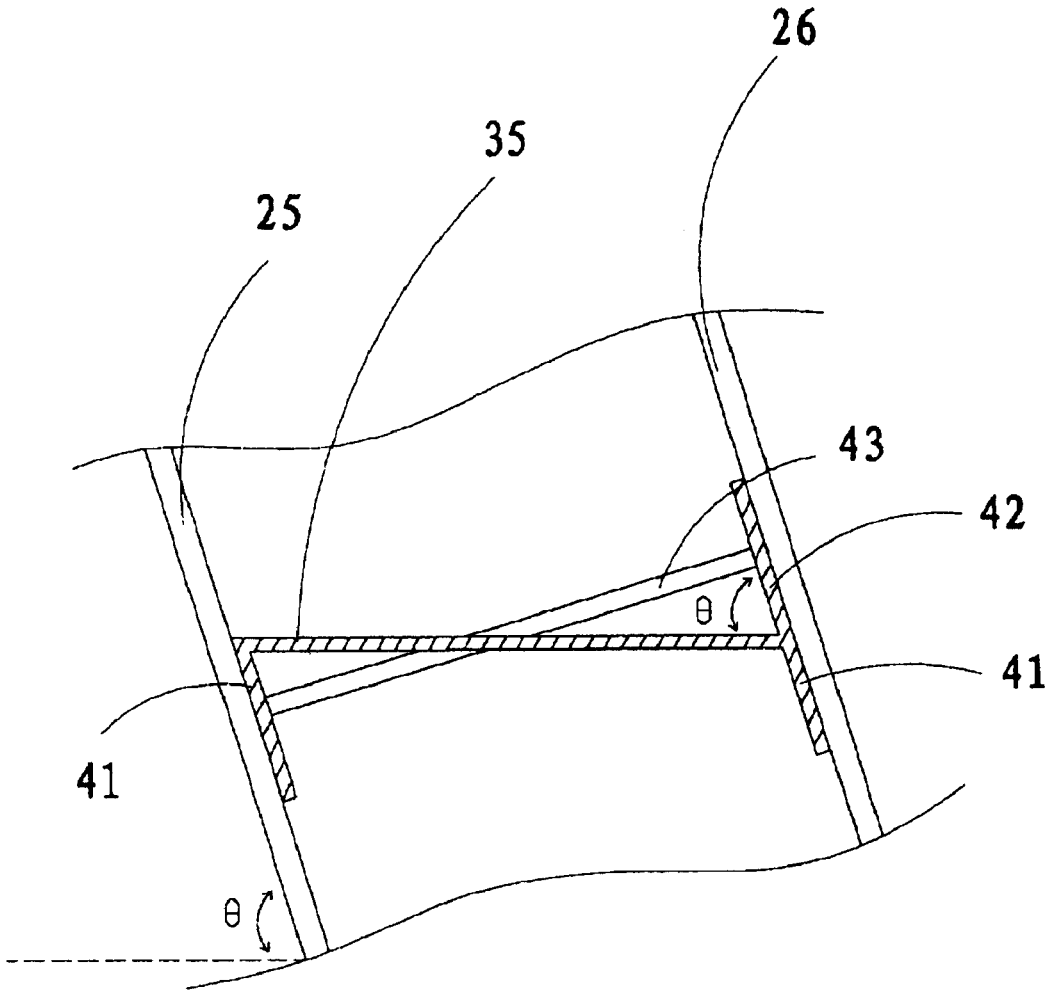

FIG. 6*b* is a sectional side view of the coupling arrangement of the foldable ladder according to the above first preferred embodiment of the present invention, illustrating that the front supporting frame is in operative mode and the step surface is horizontal, but the front supporting frame is inclined with respect to horizontal.

Figure 7A:
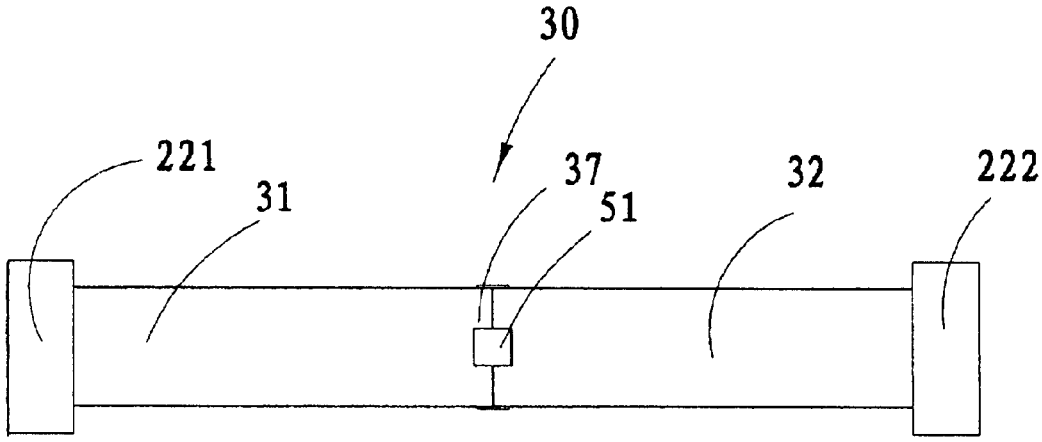

FIG. 7*a* is a top view of the first and the second step member communicated with the folding controller according to the above first preferred embodiment of the present invention, illustrating that the foot supporters are in unfolded position.

Figure 7B:
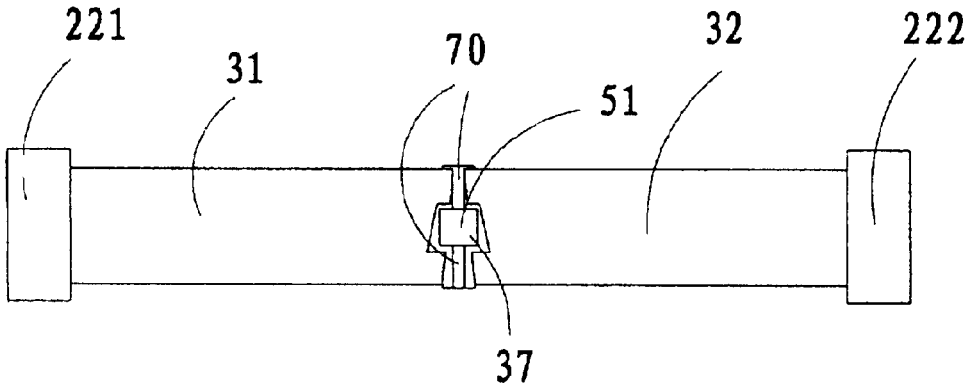

FIG. 7*b* is a top view of the first and the second step member communicated with the folding controller according to the above first preferred embodiment of the present invention, illustrating that the foot supporters are being folded.

Figure 8:
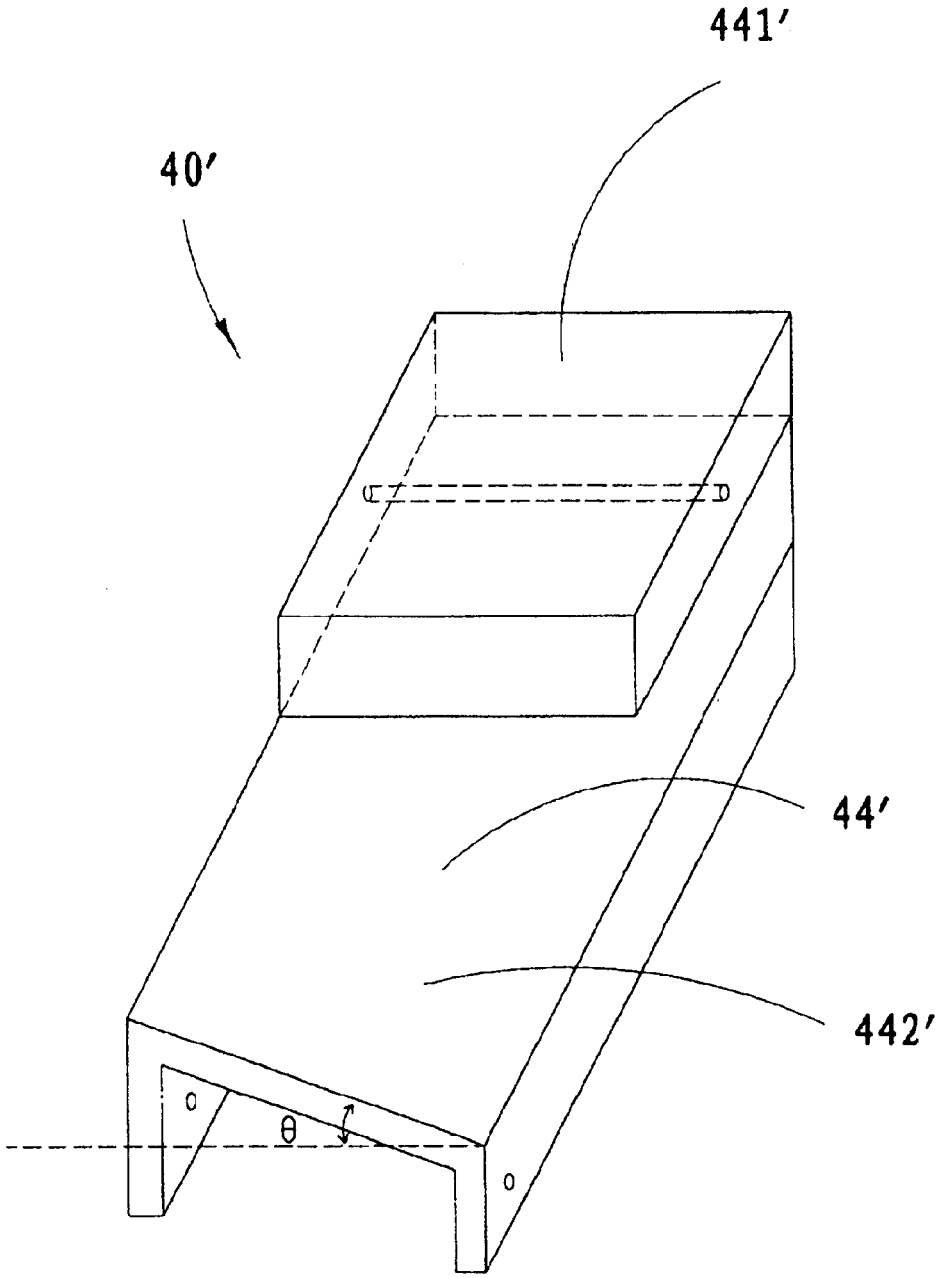

FIG. 8 is a perspective view of the foldable ladder according to a second preferred embodiment of the present invention, illustrating the coupling arrangement of the present invention.

DETAILED DESCRIPTION OF THE PREFERRED EMBODIMENT

Figure 1:
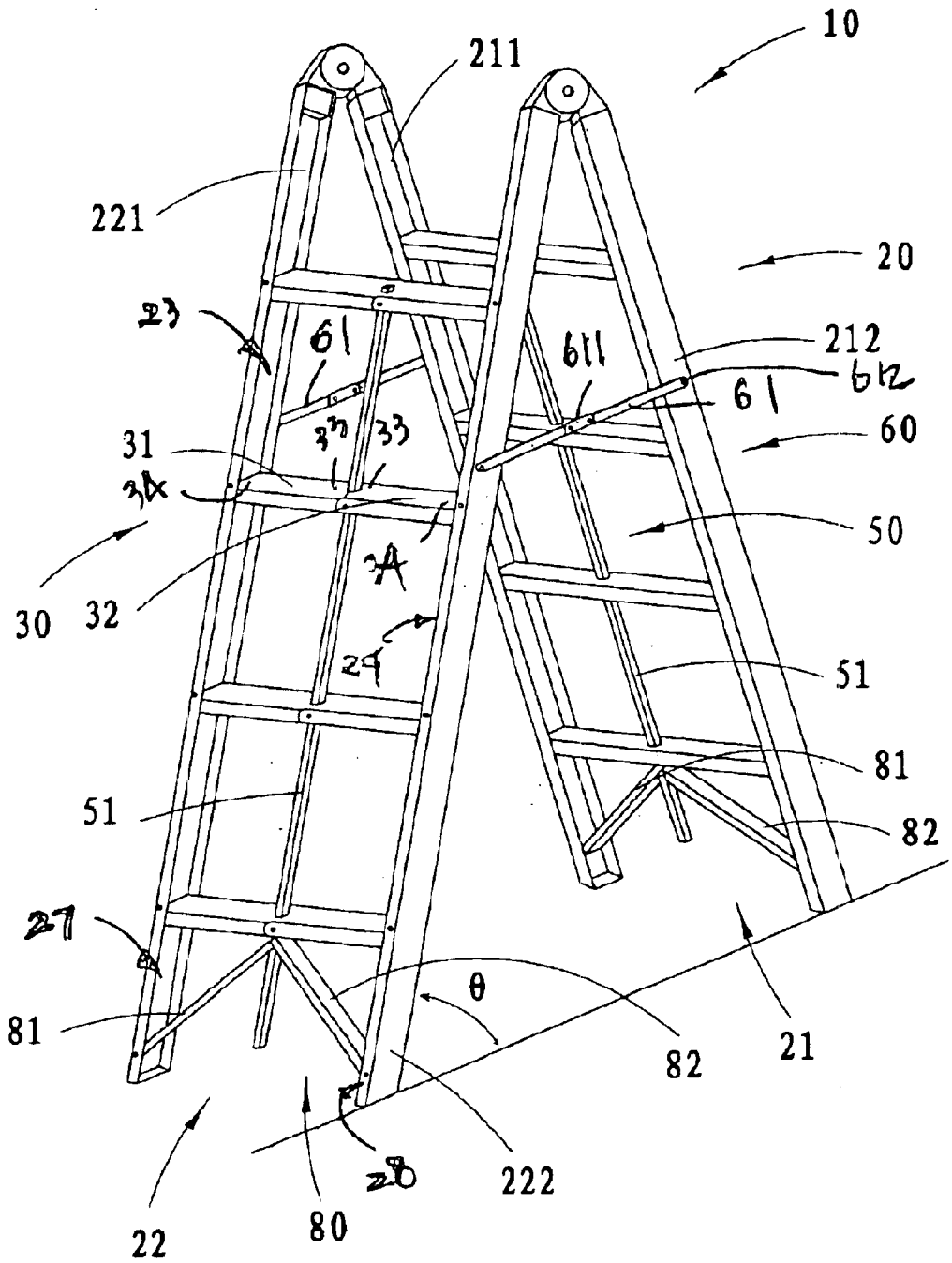
FIG. 1 is a perspective view of a foldable ladder according to a first preferred embodiment of the present invention, illustrating that the front and the back frame are in operative mode.
Figure 2:
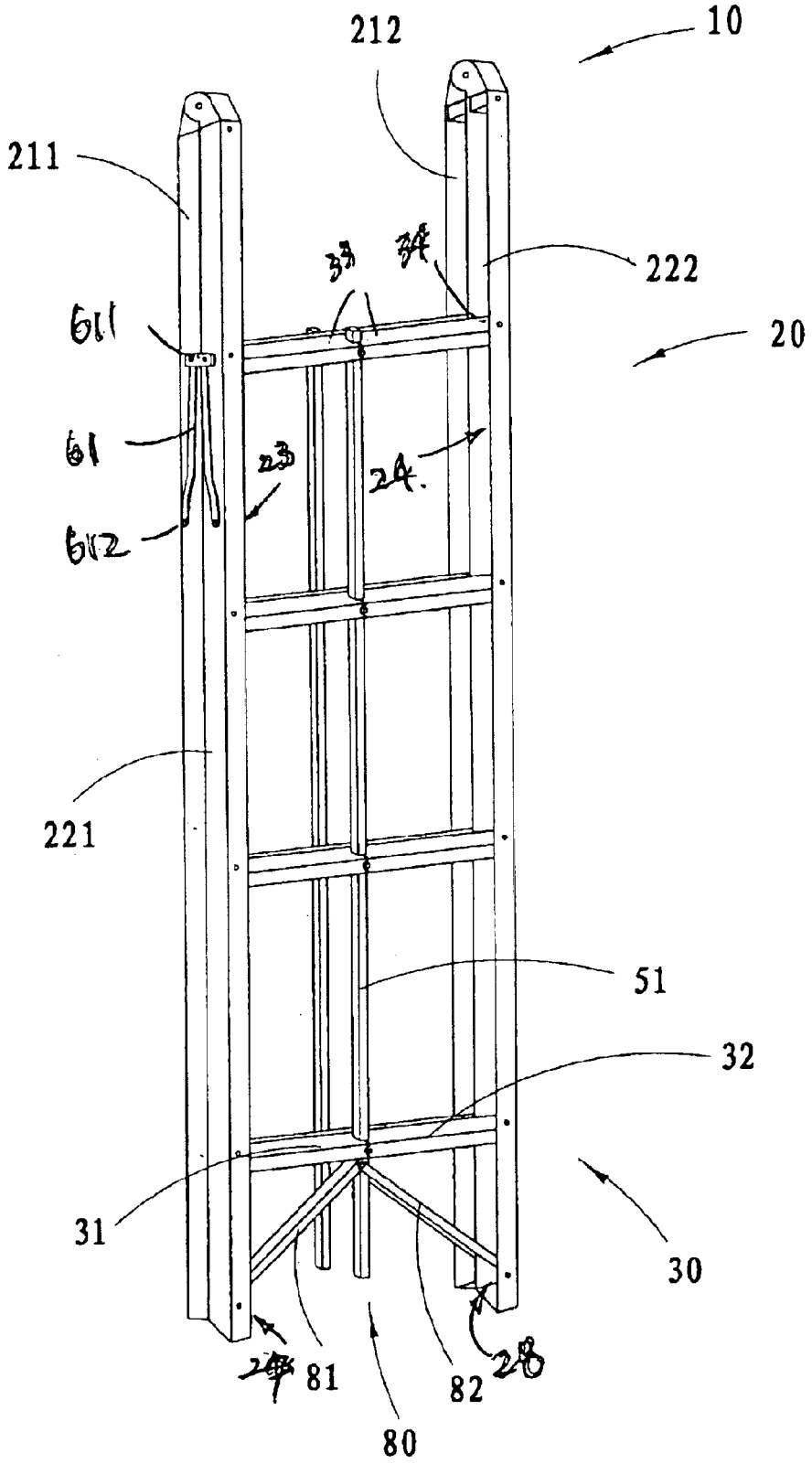
FIG. 2 is a perspective view of the foldable ladder according to the above first preferred embodiment of the present invention, illustrating that the back and the front supporting frame are in standby mode.

Referring to FIGS. 1 to 2 of the drawings, a foldable ladder 10 according to a first preferred embodiment of the present invention is illustrated. According to the first preferred embodiment of the present invention, the foldable ladder 10 comprises a ladder supporting frame 20 which comprises a back supporting frame 21 and a front supporting frame 22, a plurality of foot supporters 30 provided on the front supporting frame 22 in a pivotally foldable manner, and a foot supporters folding control mechanism 50 for folding or unfolding the all foot supporters 30 simultaneously.

The back supporting frame 21 comprises a first and a second back side leg 211, 212, whereas the front supporting frame 22 comprises a first and a second front side leg 221, 222, wherein the first and the second front side leg 221, 222 has an first and a second front inner receiving surface 23, 24 formed thereon respectively. The first and the second front side leg 211, 212 are pivotally connected to the first and the second back side legs 221, 222 respectively so that the ladder supporting frame are capable of folding between an operative mode and a standby mode, wherein in the operative mode, the back and the front supporting frame 21, 22 are pivotally unfolded apart from each other, and wherein in the standby mode, the back and the front supporting frame 21, 22 are pivotally folded toward each other so that they are overlap with each other. According to the first preferred embodiment of the present invention, when the ladder supporting frame 20 is in operative mode, the back and the front supporting frame 21, 22 are pivotally unfolded apart from each other so that they form an inverted 'V' structure securely standing on a ground. In other words, the first and the second front side leg 221, 222, as well as the first and the second back side leg 211, 212, are all inclinedly supported on the ground in the operative mode.

The foldable ladder 10 further comprises means 60 for retaining the ladder supporting frame 20 in its operative mode. The retaining means 60 comprises a pair of retaining bars 61 each having a pivot end 611 and a mounting end 612, wherein the mounting ends 612 of the pair of retaining bars 61 are pivotally mounted on the first front side leg 221 and the first back side leg 211 respectively for pivotally connecting the back supporting frame 21 and the front supporting frame 22, and in particular retaining the front supporting frame 22 and the back supporting frame in the operative mode. The pivot ends 611 of the pair of retaining bars 61 pivotally connected with each other so as to facilitate the folding action of the ladder supporting frame 20. Thus the back and the front supporting frame 21, 22 are capable of retaining in the operative mode and folding into the standby mode. Of course, the pair of retaining bars 61 can also be pivotally mounted onto the second front side leg 222 and the second back side leg 212 respectively. Moreover, the retaining can even further comprises a pair of retaining bars 61, wherein the two pairs of retaining bars 61 are mounted on the first and the second front and the back side legs 211, 212, 221, 222 respectively.

Each of the plurality of foot supporters 30 comprises a first and a second step member 31, 32 pivotally and foldably provided on the front supporting frame 22 for supporting a weight of a user of the foldable ladder 10. Each of the step members 31, 32 has an inner end portion 33, an outer end portion 34 and a step surface 35 formed therebetween. The foldable ladder 10 further comprises a plurality of pivot joint 70, each pivotally connecting two inner end portions 33 of the first and the second step member 31, 32 of each of the foot supporters 30 in a foldable manner.

Figure 3:
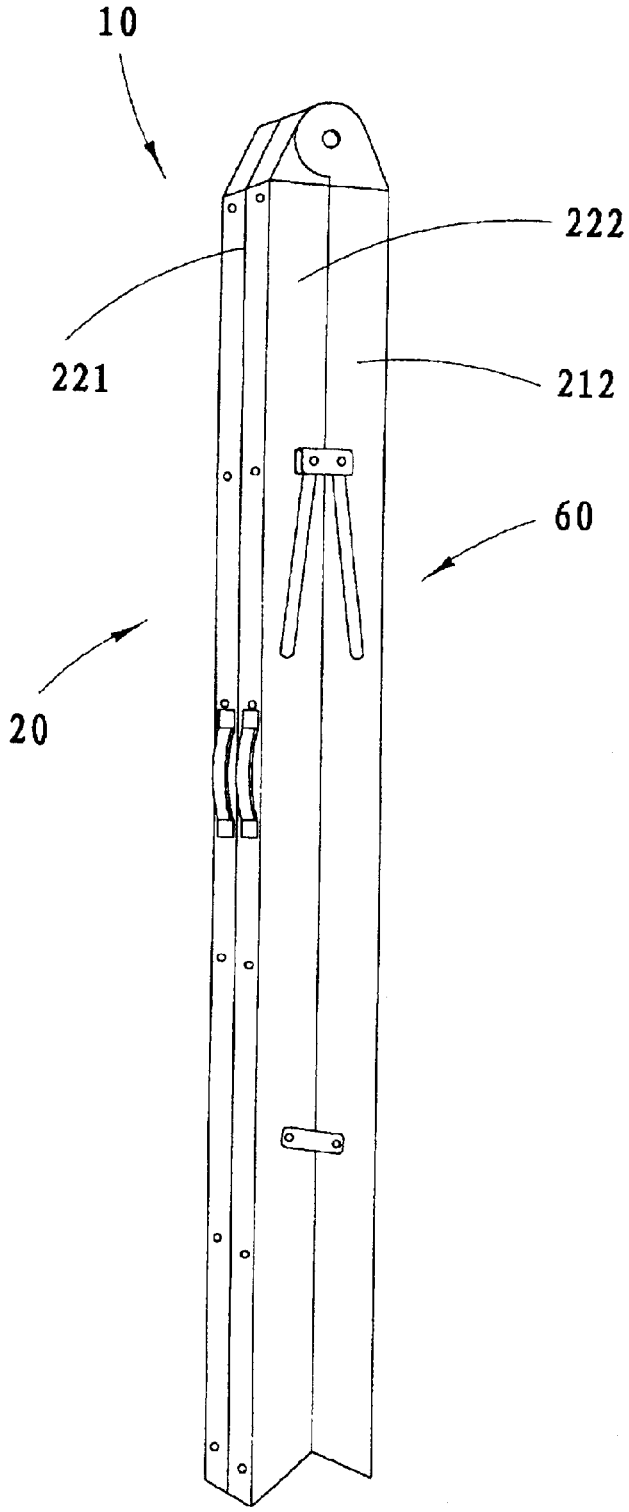
FIG. 3 is a perspective view of the foldable ladder according to the above first preferred embodiment of the present invention, illustrating that the foot supporters are in the folded position.

Referring to FIGS. 2 to 3 of the drawings, the outer end portions 34 of each of the first and the second step member 31, 32 are coupled with the first and the second front and back side lees 211, 212, 221, 222 respectively in such a manner that the foot supporters 30 are capable of being folded between an unfolded position and a folded position. In the folded position, the first and the second step member 31, 32 are pivotally and upwardly folded toward the first and the second front inner receiving surface 23, 24 respectively, and in the unfolded position, the first and the second step member 31, 32 are pivotally unfolded and extended such that the step surface 35 of the first and the second step member 31, 32 is well-aligned with each other and are kept horizontal.

The first and the second front side leg 221, 222 further has a first and a second pair of front sidewalls 25, 26 inwardly extended from the first and the second front inner receiving surface 23, 24 respectively. Thus, a first front receiving cavity 27 is defined between the first pair of front sidewalls and the first inner receiving surface 23, while a second front receiving cavity 28 is defined between the second pair of front sidewalls 26 and the second front inner receiving surface 24.

When the foot supporters 30 are in their folded position, each of the first step members 31 are received inside the first front receiving cavity 27, whereas each of the second step member 32 are received inside the second front receiving cavity 28.

Referring to FIGS. 1 to 4*b* of the drawings, the foot supporter folding control mechanism 50 comprises a folding controller 51 having an elongated body pivotally connecting all the pivot joints 70 in a pivotally movable manner. Thus, when one of the foot supporter 30 is being folded or unfolded, that particular foot supporter 30 will as well drive other foot supporters 30 to fold or unfold through the elongated folding controller 51. In other words, the folding controller 51 is capable of facilitating a simultaneous folding or unfolding operation of all the foot supporters 30.

The foldable ladder 10 further comprises a central support arrangement 80 which comprises a first and a second reinforcing members 81, 82 pivotally and slidably connecting a bottom portion of the folding controller 51 to the first and the second front side legs 221, 222 respectively, so as to provide a reinforcing structural element to enhance the supporting strength of the foot supporters 30. Thus, part of the loading applied to the foot supporters 30 can be directed to the front side legs 221, 222 through the folding controller 51 and the reinforcing members 81, 82, so as to reinforce the supporting strength of the foot supporters 30, instead of merely relying on the coupling arrangements or joints between the foot supporters 30 and the front side legs 221, 222, as in the case of conventional foldable ladders.

FIGS. 5, 6*a*, 6*b* of the drawings illustrate a plurality of coupling arrangements 40 for pivotally connecting the foot supporters 30 with the front supporting frame 22 according to the first preferred embodiment of the present invention, wherein the plurality of coupling arrangements 40 are supported inside the first and the second front receiving cavity 27, 28, All the step members 31, 32 have an elongated slot 36 transversely formed on their respective outer end portion 34 for coupling with one of the coupling arrangements 40 in a pivotally foldable manner. Each of the coupling arrangements 40 comprises a lower mounting panel 41 downwardly and integrally extended from the outer end 34 of one of the step members 31, 32, an upper mounting panel 42 upwardly and integrally extended from the outer end 34 of one of the step members 31, 32, and a folding axle 43 having two ends respectively mounted on the pairs of sidewalls 25, 26 in which the step member 31, 32 is received, wherein the folding axle 43 is arranged to penetrate the lower and the upper mounting panel 41, 42 through the elongated slot 36 formed on the step member 31, 32.

The folding axles 43 of the coupling arrangements 40 are horizontally mounted onto the sidewalls 25, 26. Therefore, the foot supporters 30 has got to be coupled with the coupling arrangements 40 in such a manner that the step surface 35 of each of the step member 31, 32 is downwardly inclined with an angle θ with respect to horizontal. In order to achieve the object that the step surfaces 35 are horizontal when the foot supporters 30 are in their unfolded position, the maximum angle of inclination of the front supporting frame 22 when it is in the operative mode should be restricted to an angle equal to the angle of inclination of the step surface 35, i.e. θ. As a consequence, when the ladder supporting frame 20 is in standby mode, the each of the step surfaces 35 make an angle θ with respect to horizontal, while when the ladder supporting frame 20 is in operative mode, the front side legs 221, 222 are pivotally unfolded to inclinedly supported on the ground at an angle θ, so that all step surfaces are displaced at an angle θ to orient horizontally.

By the above-mentioned structural arrangements, when the foot supporters 30 are in unfolded position, and that the ladder supporting frame 20 is in operative mode, the step surfaces 35 of each of the step members 31, 32 are horizontally oriented. When each of the foot supporters 30 is being folded, its two corresponding step members 31, 32 are folded toward the two front receiving cavities 27, 28 of the two front side legs 221, 222 about their corresponding folding axles 43 until the two step members 31, 32 are completely received inside the front receiving cavities 27, 28.

It is important to mention that, as a pre-requisite condition that the first and the step member 31, 32 are capable of completely receiving into the first and the second front receiving cavity 27, 28 respectively, the principle edges, i.e. the edges along their length, of the first and the second step member 31, 32 should, when they are in folded position, be parallel with the first and the second front side leg 221, 222 respectively, and that the width of them should also be slightly smaller than that of the width of the first and the second front receiving cavity 27, 28 respectively.

Referring to FIGS. 7*a*, 7*b* of the drawings, for each of the foot supporters 30, the first and the second step member 31, 32 each further has a through slot formed on their respective inner ends 33, wherein the two through slots are well-aligned to define an controller slot 37 for the folding controller 51 to pass through. Accordingly, the folding controller 51 connects all the pivot joints 70 by passing through the controller slot 37 of each of the foot supporters 30. Thus, when the folding controller 51 moves, all the foot supporters 30 are driven to move simultaneously. And since all the foot supporters 30 are pivotally connected to the front side legs 221, 222 at their respective outer end 33, when a user pushes up the folding controller 51, the foot supporters 30 are driven to fold up at the same time to receive into the two front receiving cavities 27, 28, and the first and the second front side legs 221, 222 are moved toward each other.

On the other hand, since the folding controller 51 is connected with all the pivot joints 70, and the pivot joints 70 are connected with the foot supporters 30, therefore, any loading exerted onto the foot supporters is, in addition to be supported by the coupling arrangements 40, also substantially supported by the folding controller 51 and the two reinforcing members 81, 82 pivotally and slidably connected thereto. In other words, the folding controller 51 is not only helps in facilitating simultaneous folding of all foot supporters 30, but also helps in directing any loading exerted on the foot supporters 30 to the ladder supporting frame 20 via the two reinforcing members 81, 82.

It is important to stress that the above-mentioned foot supporters 30, the coupling arrangements 40, the foot supporters folding control mechanism 50, the pivot joints 70 and the central support arrangement 80 can also be mounted on the back supporting frame 21 in the same manner as that of the front supporting frame 21, as shown in FIG. 1 of the drawings.

Referring to FIG. 8 of the drawings, an alternative mode a of the present invention is illustrated. In which, each of the coupling arrangements 40' comprises a mounting member 44' having a mounting portion 441' securely and horizontally mounted inside the front receiving cavities and an inclined portion 442' adapted to be mounted to the step members. The outer end of each of the step members are pivotally and foldably mounted to the inclined portion 442' of the mounting member 44' via a through hole formed thereon so that each of the step surfaces makes an angle θ' with the horizontal when the ladder supporting frame is in standby mode. Accordingly, when the ladder supporting frame is unfolded to the operative mode, the step surfaces are accordingly displaced to orient horizontally.

What is claimed is:

1. A foldable Ladder, comprising:

a ladder supporting frame, which comprises:

a back supporting frame which comprises a first and a second parallel back side leg; and a front supporting frame which comprises a first and a second parallel front side leg having a first and second inner receiving surface formed thereon respectively, wherein said first and said second front side leg are pivotally connected to said first and said second back side leg respectively so that said ladder supporting frame is capable of selectively folding between an operative mode and a standby mode, wherein in said operative mode, said front supporting frame is pivotally unfolded apart from said back supporting frame, and is inclinedly supported with respect to horizontal, and wherein in said standby mode, said front and said back supporting frame are pivotally folded to overlap with each other;

means for retaining said ladder supporting frame in said operative mode;

a plurality of foot supporters, each comprising a first and a second step member, wherein each step member has an outer end, and inner end and a step surface formed therebetween;

a pivot joint pivotally connecting said inner end of said first and said second step member and said outer ends of said first and said second step member of each of said foot supporters are pivotally coupled with said first and said second back side leg and said first and said second front side leg respectively in such a manner that each of said foot supporters is capable of being folded between an unfolded position and a folded position, wherein in said folded position, said first and said second step member of each of said foot supporters are pivotally and upwardly folded toward said first and said second inner receiving surface respectively so as to reduce a distance between said first and said second front side leg, and wherein in said unfolded position, said first and said second step member are pivotally and downwardly unfolded from each other to an extent that said step surface of said first step member is aligned with said step surface of said second step member, while said step surfaces are both horizontal; and a foot supporters folding control mechanism; which comprises a folding controller pivotally connecting said pivot joints in such a manner that said folding controller is capable of folding said foot supporters simultaneously between said folded position and said unfolded position;

a plurality of coupling arrangement for pivotally connecting said foot supports with said front supporting frame being supported inside a first and second front receiving cavity, wherein said first and said second front side leg have a first and a second pair of sidewalls inwardly extended from said first and said second inner receiving surface to define said first and said second front receiving cavity for receiving said coupling arrangements, and wherein said first and said second step member of each of said foot supporters have an elongated slot transversely formed on said respective outer end, for coupling with one of said coupling arrangements, each of said coupling arrangements comprising a lower mounting panel downwardly and integrally extended from said outer end of said step members, an upper mounting panel upwardly and integrally extended from said outer end of said step member, and a folding axle having two ends horizontally mounted on said pair of respective sidewalls, wherein said folding axle is arranged to penetrate said lower and said upper mounting panel through said elongated slot, such that when said foot supporters are in said unfolded position and when said ladder supporting frame is in said standby mode, said step surfaces are downwardly inclined with respect to horizontal, and when said ladder supporting frame is in said operative mode, said step surfaces are held horizontal.

2. A foldable ladder, as recited in claim 1, wherein each of said foot supporters is coupled with said coupling arrangements in such a manner that, an angle of inclination of each of said step surfaces when said ladder supporting frame is in said standby mode and when said foot supporters are in said unfolded position is substantially equal to an angle of inclination of said front side legs when said ladder supporting frame is in said operative mode and when said foot supporters are in said unfolded position.

3. A foldable ladder, as recited in claim 2, wherein two principle edges of said first and second step member is parallel with said first and second front side leg, wherein said first and said step member each has a width slightly smaller than a width of said first and said second front receiving cavity, wherein when foot supporters are in folded position, said first and said second step member of each of said foot supporters are capable of completely receiving into said first and said second front receiving cavity respectively.

4. A foldable ladder, as recited in claim 3, further comprising a central support arrangement which comprises a first and a second reinforcing members pivotally and slidably connecting a bottom portion of said folding controller to said first and said second front side legs respectively for enhancing a supporting strength of said foot supporters.

5. A foldable ladder, as recited in claim 4, wherein said folding controller has an elongated body, and wherein said first and said second step member of each of said foot supporters has a through slot formed on said respective inner end, wherein said two through slots are aligned to define a controller slot for said elongated folding controller to pass through so that when said folding controller moves, said foot supporters are driven to move in a simultaneous manner.

6. A foldable ladder, as recited in claim 2, further comprising a central support arrangement which comprises a first and a second reinforcing members pivotally and slidably connecting a bottom portion of said folding controller to said first and said second front side legs respectively for enhancing a supporting strength of said foot supporters.

7. A foldable ladder, as recited in claim 6, wherein said folding controller has an elongated body, and wherein said first and said second step member of each of said foot supporters has a through slot formed on said respective inner end, wherein said two through slots are aligned to define a controller slot for said elongated folding controller to pass through so that when said folding controller moves, said foot supporters are driven to move in a simultaneous manner.

8. A foldable ladder, as recited in claim 1, further comprising a central support arrangement which comprises a first and a second reinforcing members pivotally and slidably connecting a bottom portion of said folding controller to said first and said second front side legs respectively for enhancing a supporting strength of said foot supporters.

9. A foldable ladder, as recited in claim 8, wherein said folding controller has an elongated body, and wherein said first and said second step member of each of said foot supporters has a through slot formed on said respective inner end, wherein said two through slots are aligned to define a controller slot for said elongated folding controller to pass through so that when said folding controller moves, said foot supporters are driven to move in a simultaneous manner.

* * * * *